US009273842B2

(12) United States Patent
Yang

(10) Patent No.: US 9,273,842 B2
(45) Date of Patent: Mar. 1, 2016

(54) WATER LAMP

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 0 days.

(21) Appl. No.: 14/326,480

(22) Filed: Jul. 9, 2014

(65) Prior Publication Data

US 2016/0010819 A1 Jan. 14, 2016

(51) Int. Cl.

| | |
|---|---|
| ***F21V 33/00*** | (2006.01) |
| ***F21S 10/00*** | (2006.01) |
| ***F21V 23/04*** | (2006.01) |
| ***F21V 35/00*** | (2006.01) |
| *F21W 121/00* | (2006.01) |

(52) U.S. Cl.

CPC ..... *F21S 10/002* (2013.01); *F21V 23/0485* (2013.01); *F21V 35/00* (2013.01); *F21W 2121/00* (2013.01)

(58) Field of Classification Search

CPC .... G09B 27/08; F21V 33/00; F21W 2131/00; F21S 10/002

USPC ..... 362/809, 811, 101

See application file for complete search history.

(56) References Cited

U.S. PATENT DOCUMENTS 5,678,918 A * 10/1997 Lin ..... 362/96
8,905,567 B2 * 12/2014 Ho ..... 362/101
8,911,101 B2 * 12/2014 Tsai ..... 362/101

* cited by examiner

*Primary Examiner* — Anabel Ton
(74) *Attorney, Agent, or Firm* — Leong C. Lei

(57) ABSTRACT

The water lamp contains a main member, a base, an upper seat, and an agitation element. The base and the upper seat are joined to a top end and a bottom end of the main member, respectively. The agitation element is housed in the main member. Inside the base, there is an illumination element and a magnetic axle controlled by a control circuit. The agitation element is attracted by the magnetism of the axle and spins along with the axle so as to agitate the fluid inside the main member. The upper seat has an accommodation space for supporting a candle. The agitation element is spun by and along with the axle. The fluid inside the main member is stirred and, through the illumination by the illumination element, interesting and dynamic visual effects are produced.

9 Claims, 14 Drawing Sheets

WATER LAMP

BACKGROUND OF INVENTION (a) Technical Field of the Invention

The present invention is generally related to water lamps, and more particular to a multi-function water lamp that can function as a candlestick or a lampstand.

(b) Description of the Prior Art

The application of candles has long been extended from simple illumination to ceremonies, worship, home decoration, and atmosphere creating. As its usage and function are widely expanded, candle has become one of people's daily necessities.

Conventional candlesticks are designed with various styles so as to be more visually appealing. However, what is delivered is a static visual impression. What would be even more attractive is to have dynamically varied visual effect.

SUMMARY OF THE INVENTION

A major objective of the present invention is to enhance the visual appealing of candlesticks.

Therefore, the present invention provides a water lamp which contains the following components.

A main member has a translucent casing and a translucent bottom cover, jointly forming a hollow body filled with a fluid.

A base supports and joins to a bottom end of the main member. Inside the base and beneath the bottom cover, there is an illumination element and a magnetic axle controlled by a control circuit.

An upper seat is joined to an upper end of the main member, and has an accommodation space with an open top.

An agitation element is housed in the main member and has a semi-spherical shape with radial fins on a planar top side. The agitation element is attracted by the magnetism of the axle and spins along with the axle so as to agitate the fluid inside the main member.

Therefore, the gist of the present invention lies in the agitation element is spun by and along with the axle. The fluid inside the main member is stirred and, through the illumination by the illumination element, interesting and dynamic visual effects are produced.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become apparent to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
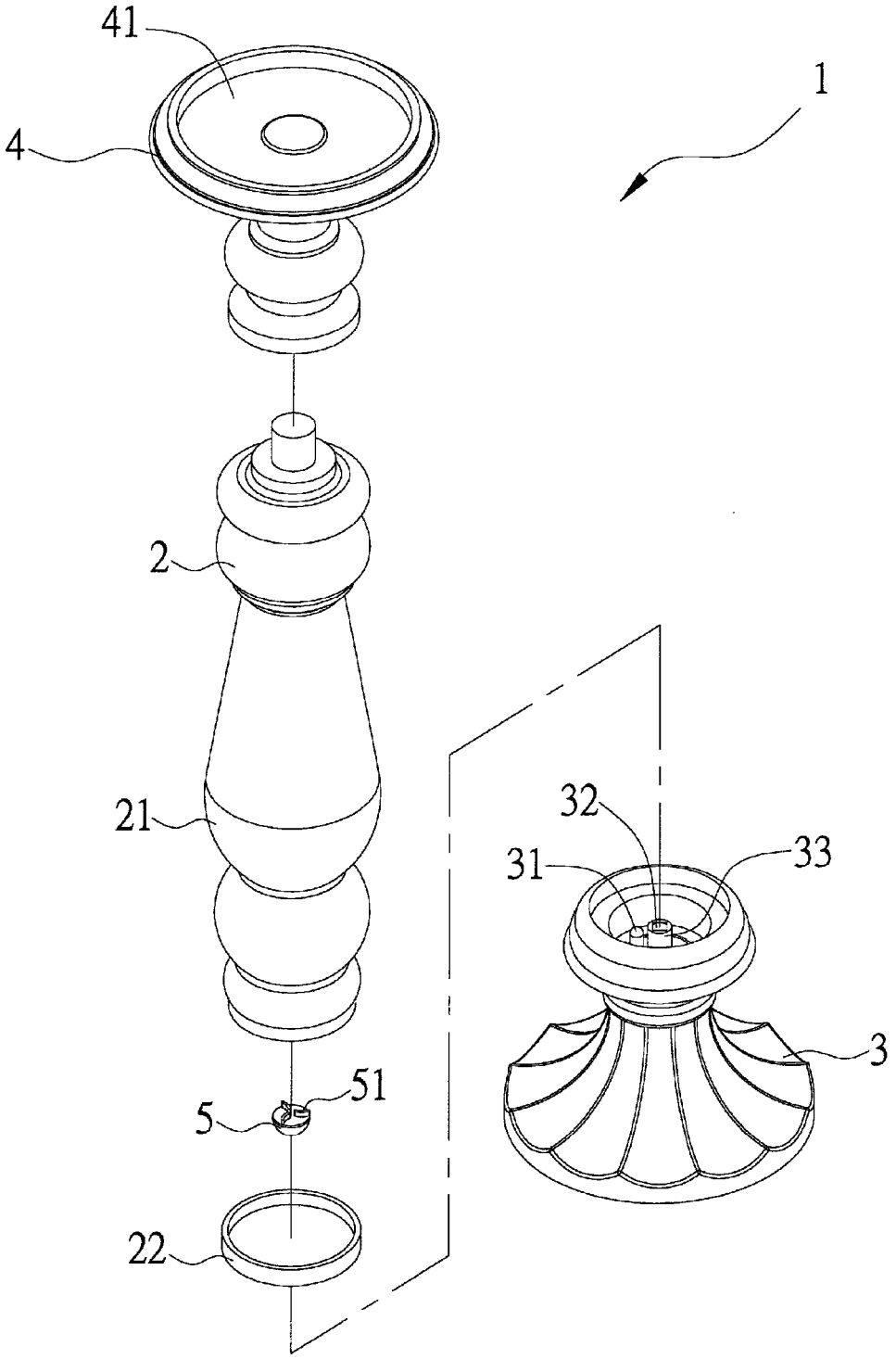
FIG. 1 is a perspective break-down diagram showing the various parts of a water lamp functioning as a candlestick according to a first embodiment of the present invention.
Figure 2:
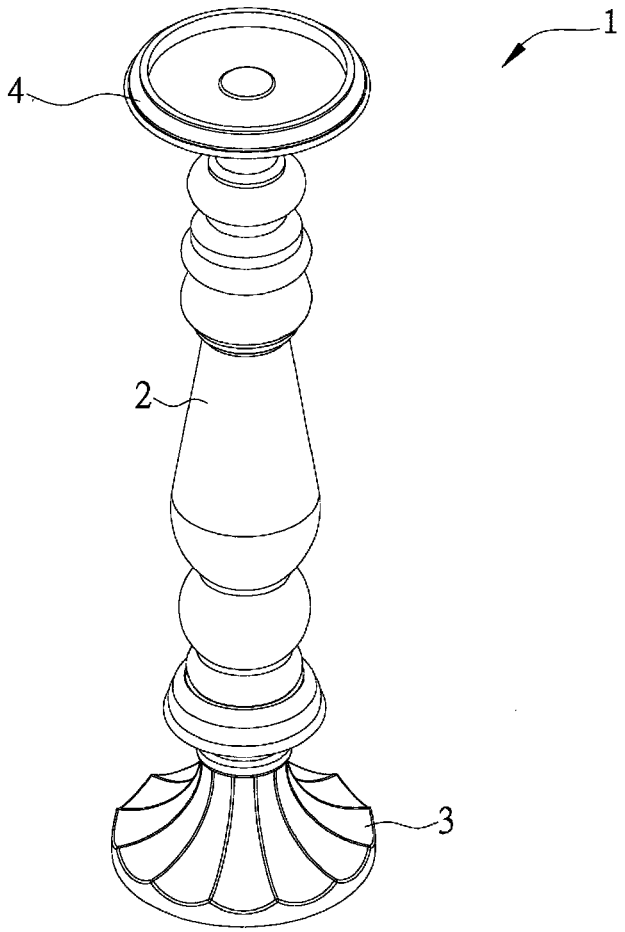
FIG. 2 is a perspective diagram showing the candlestick of FIG. 1 after its assembly.
Figure 3:
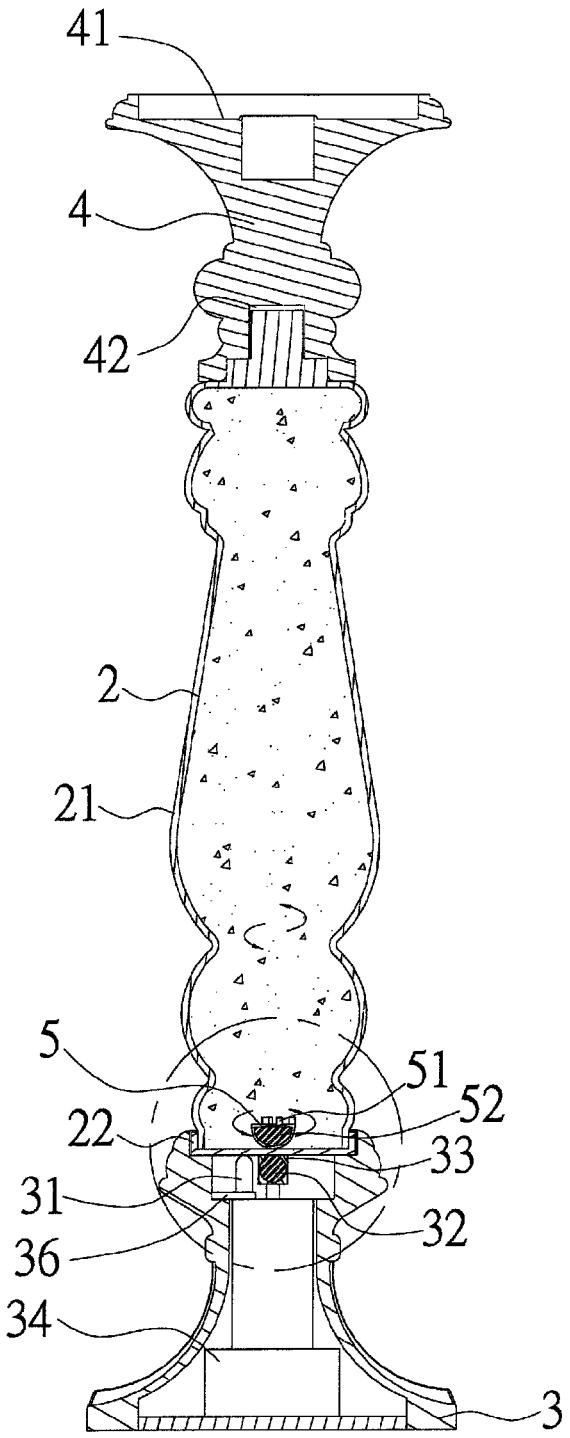
FIG. 3 is a sectional diagram showing the candlestick of FIG. 2.
Figure 3A:
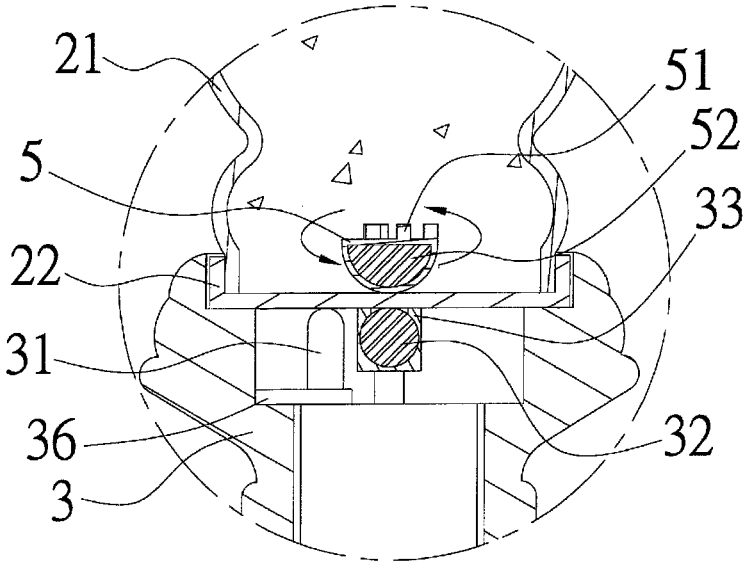
FIG. 3*a* is an enlarged diagram showing the interaction between an agitation element and an axle of the candlestick of FIG. 2.
Figure 4:
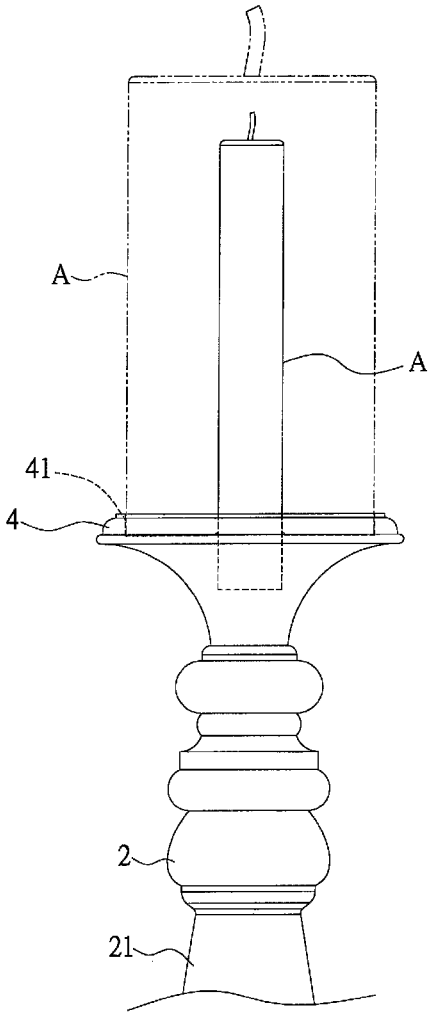
FIG. 4 is a schematic diagram showing the candlestick of FIG. 2 in supporting candles of different diameters.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 4, a first embodiment of the present invention is a candlestick 1, which contains a main member 2, a base 3, an upper seat 4, and an agitation element 5.

The main member 2 has a translucent casing 21 and a translucent bottom cover 22, thereby forming a hollow body filled with a fluid. In the present embodiment, the casing 21 is of a pillar shape and the fluid is blended with spangles or glittering powders so to enhance its visual appeal.

Figure 10:
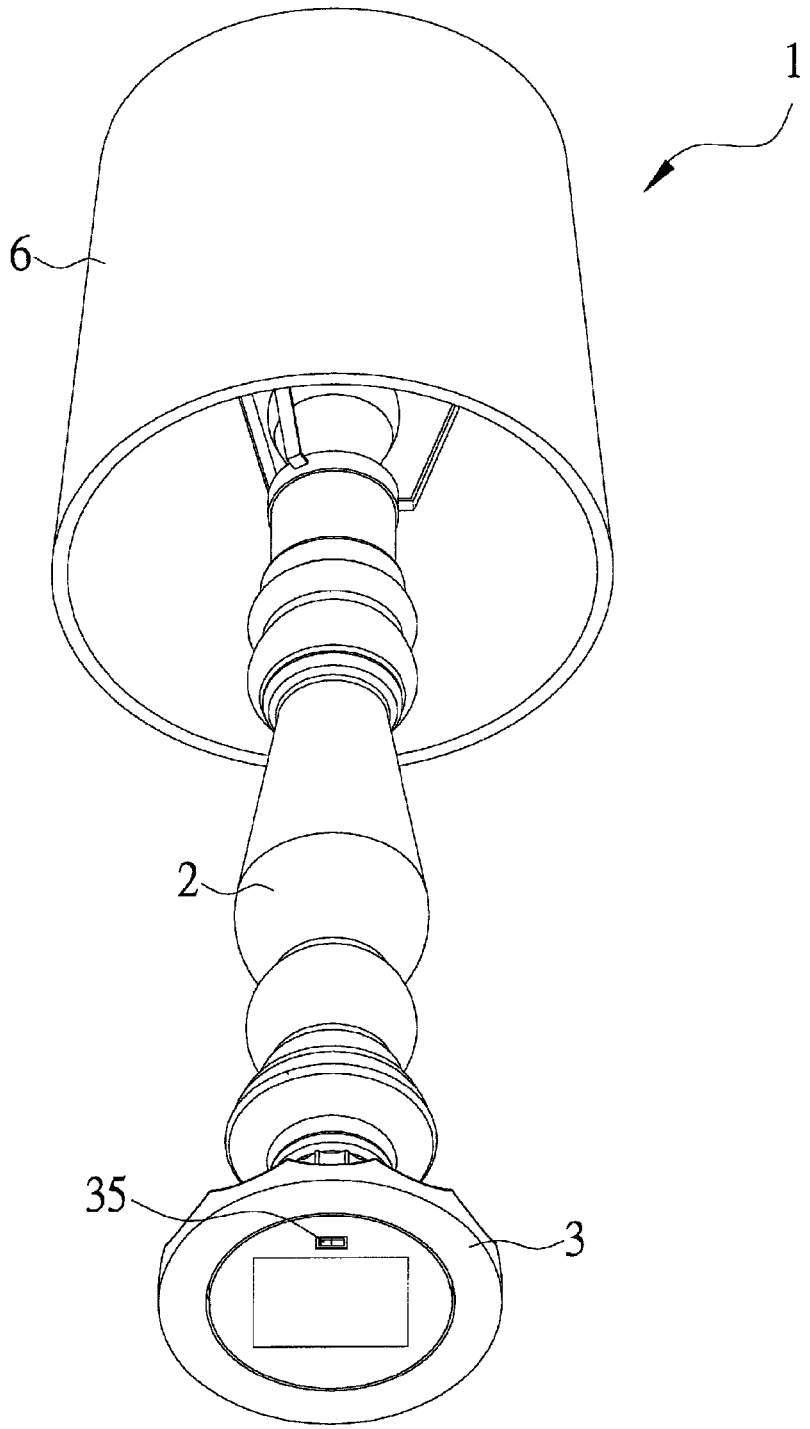
FIG. 10 is another perspective diagram showing the lampstand of FIG. 8 revealing a switch of the lampstand.

The base 3 supports and joins to a bottom end of the main member 2. Inside the base 3 and beneath the bottom cover 22, there is an illumination element 31 and a magnetic axle 33. The axle 33's magnetism arises from a magnetic element 32, such as a magnet, fixed to a top end of the axle 33. The axle 33 is driven by a power element 34 to spin. The illumination element 31, the axle 33, and the power element 34 are controlled by a control circuit 36, which is also housed inside the base 3. A switch 35, as shown in FIG. 10, is configured on a bottom side of the base 3 for turning on and off the control circuit 36. The control circuit 36 can control the on/off frequency and light color of the illumination element 31, and the axle 33's intermittent rotation and speed. In the present embodiment, the power element 34 is a motor and the axle 33 is extended from the motor.

The upper seat 4 is joined to an upper end of the main member 2, and has an accommodation space 41 with an open top. In the present embodiment, the upper seat 4 has a horn shape but this is only exemplary. The upper seat 4 has a socket 42 on a bottom side for joining to the top end of the main member 2 so that the accommodation space 41 can steadily support a candle A. The cross section of the accommodation space 41 can have a stepwise shape so as to support candles A of different diameters.

The agitation element 5 is housed in the main member 2 and has a semi-spherical shape with radial fins 51 on a planar top side. The agitation element 5 is attracted by the magnetism of the axle 33 and spins along with the axle 33 so as to agitate the fluid inside the main member 2. In the present embodiment, the agitation element 5 has a magnetic element 52 inside attracted to the magnetic element 32. Alternatively, the agitation element 5 itself can be made a material attracted to the magnetic element 32.

Therefore, when the axle 33 is driven to spin, the agitation element 5 is spun as well by the magnetic element 32. The fluid inside the main member 2 is stirred and, through the illumination by the illumination element 31, the reflection from the spangles and the glittering powders, interesting and dynamic visual effects are produced.

Figure 5:
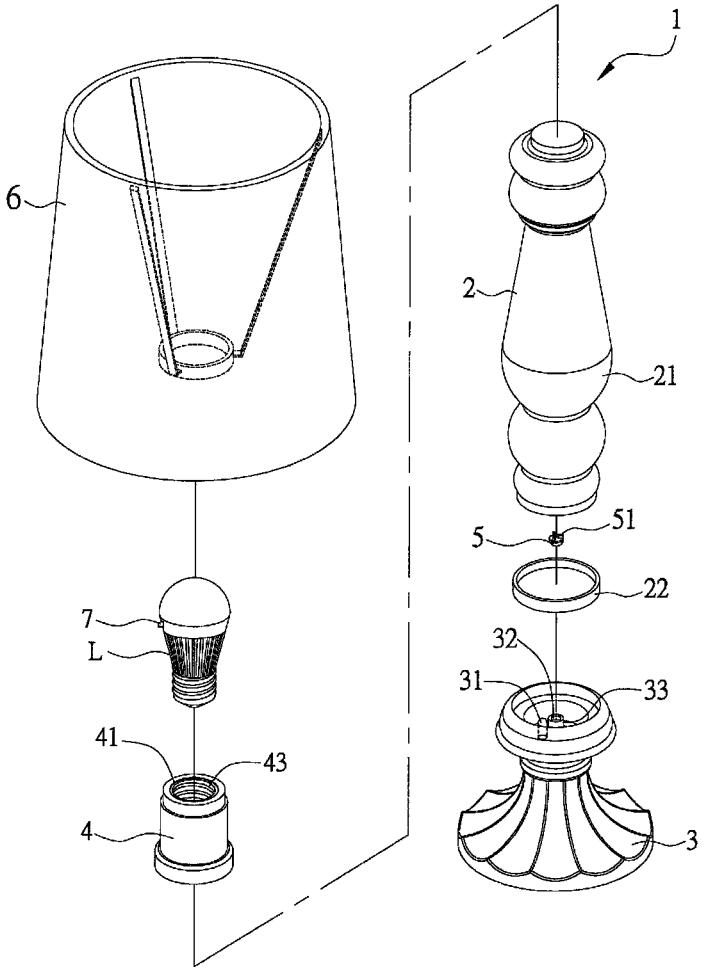
FIG. 5 is a perspective break-down diagram showing the various parts of a water lamp functioning as a lampstand according to a second embodiment of the present invention.
Figure 6:
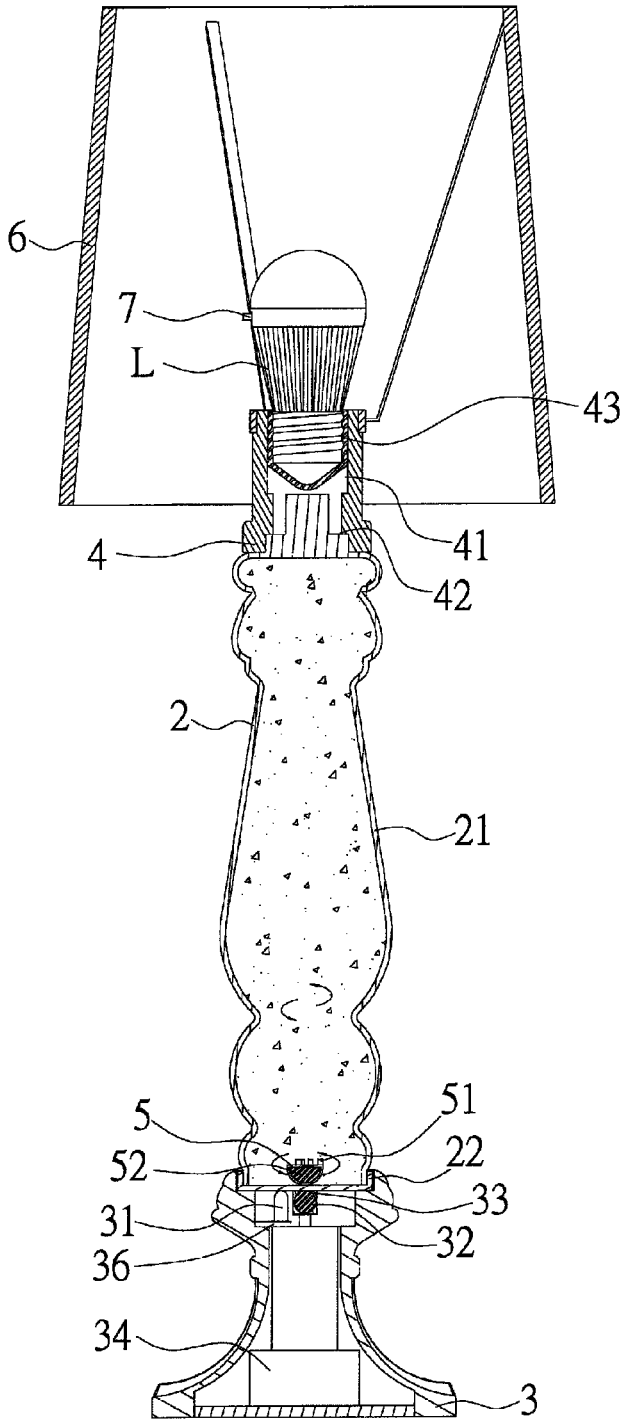
FIG. 6 is a sectional diagram showing the lampstand of FIG. 2.
Figure 7:
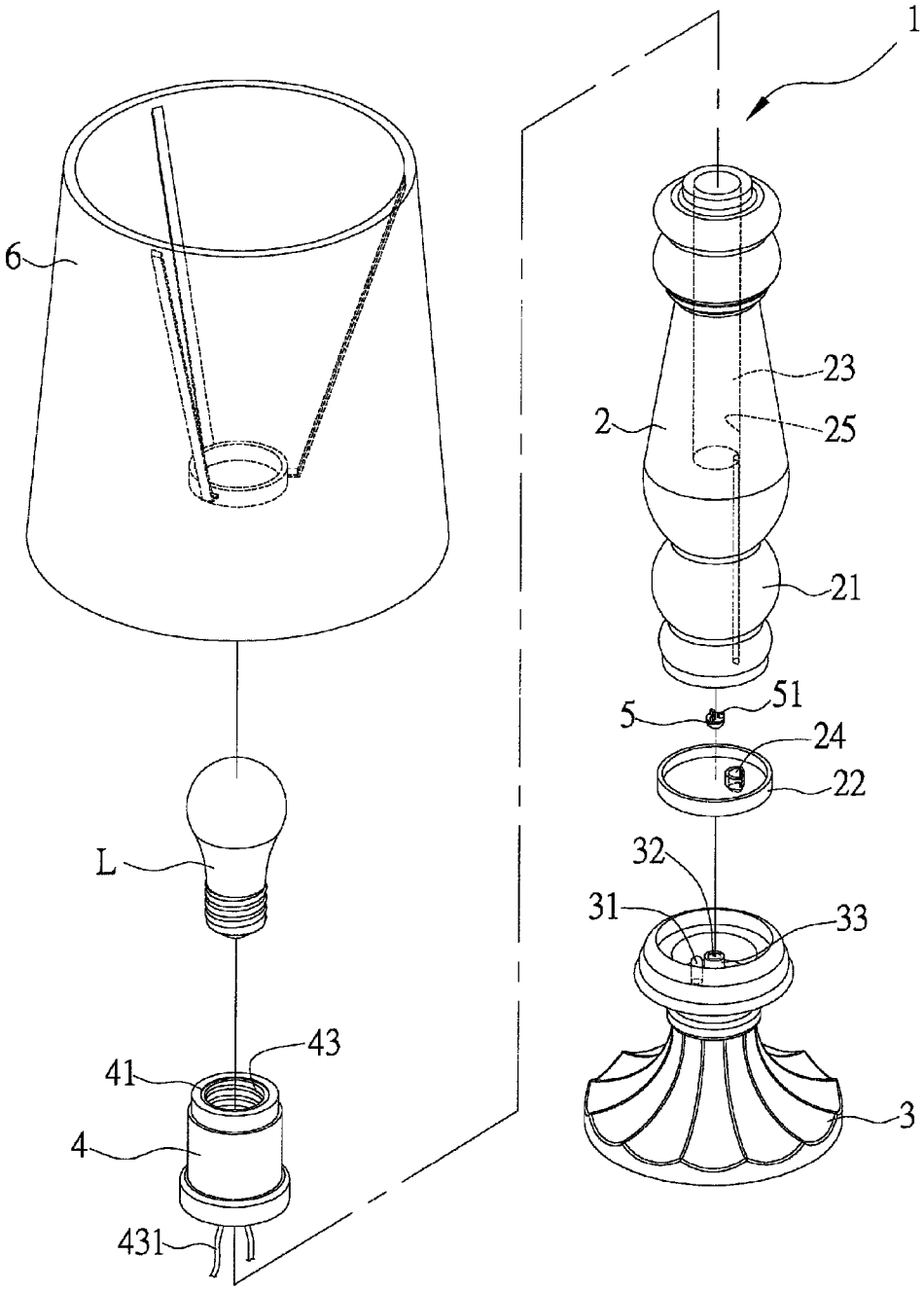
FIG. 7 is a perspective break-down diagram showing the various parts of a water lamp functioning as a lampstand according to a third embodiment of the present invention.
Figure 8:
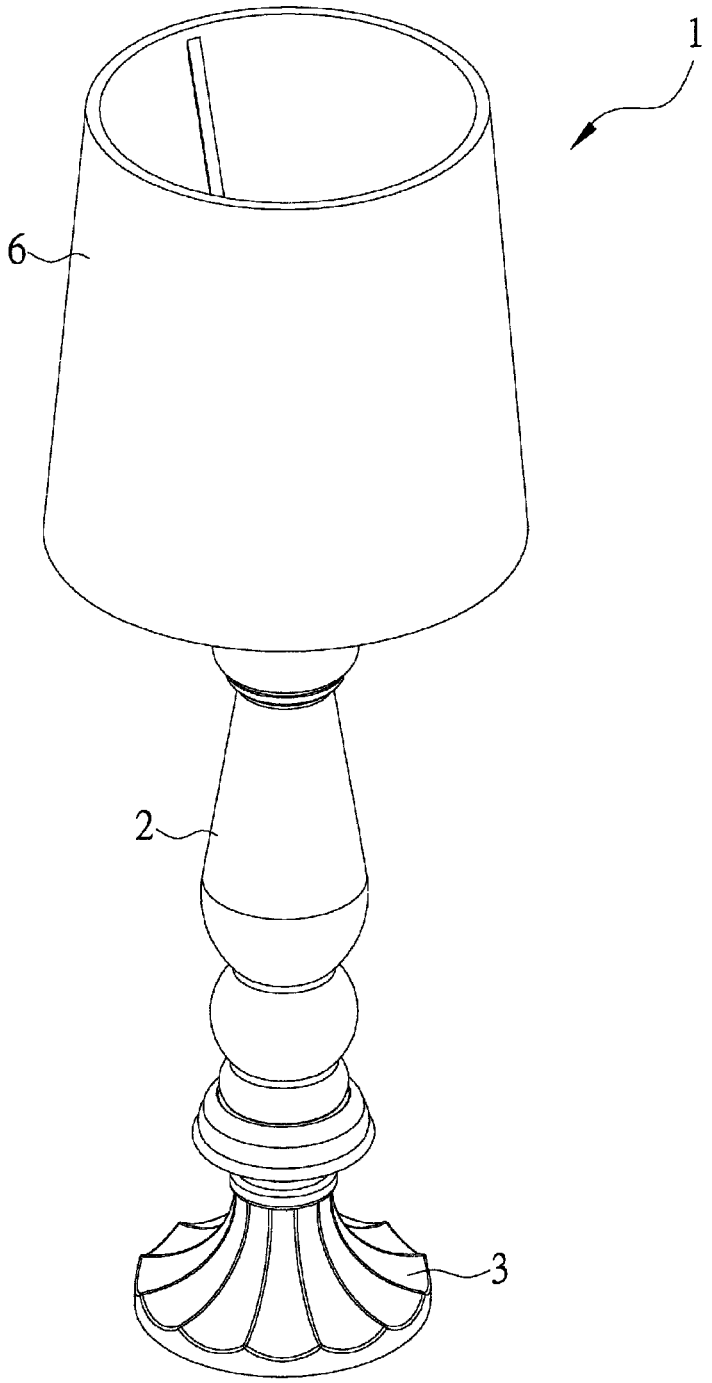
FIG. 8 is a perspective diagram showing the lampstand of FIG. 7 after its assembly.
Figure 9:
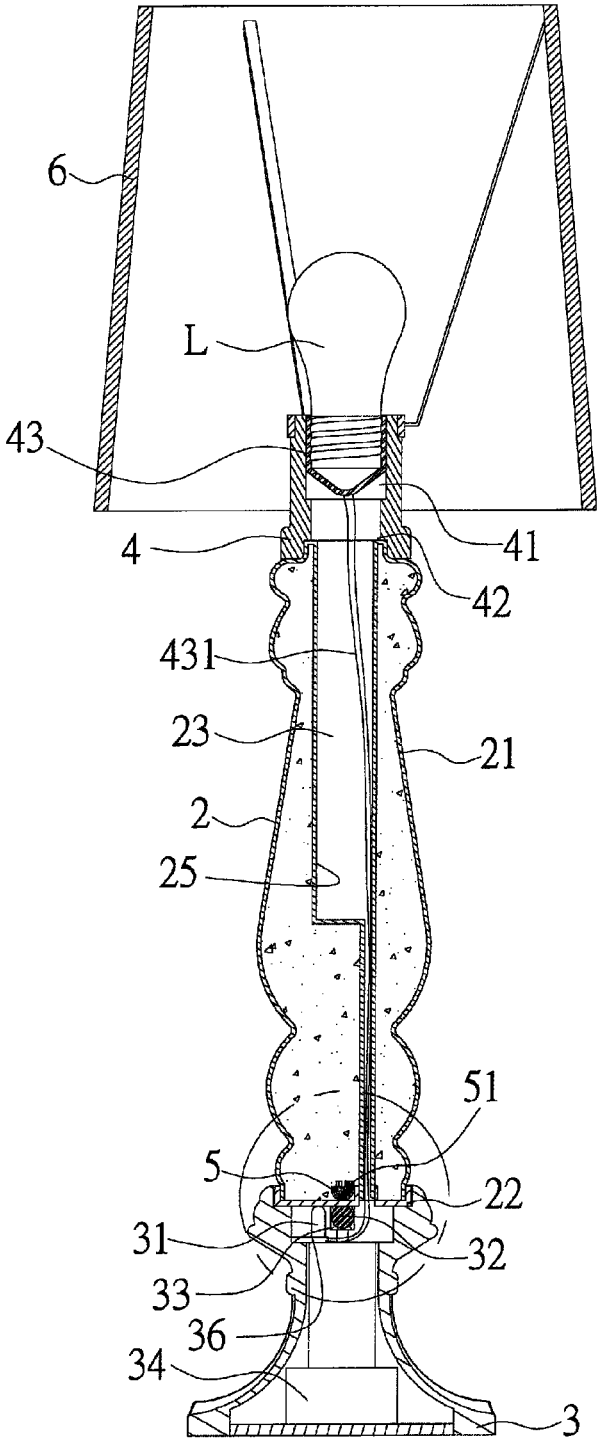
FIG. 9 is a sectional diagram showing the lampstand of FIG. 8.
Figure 9A:
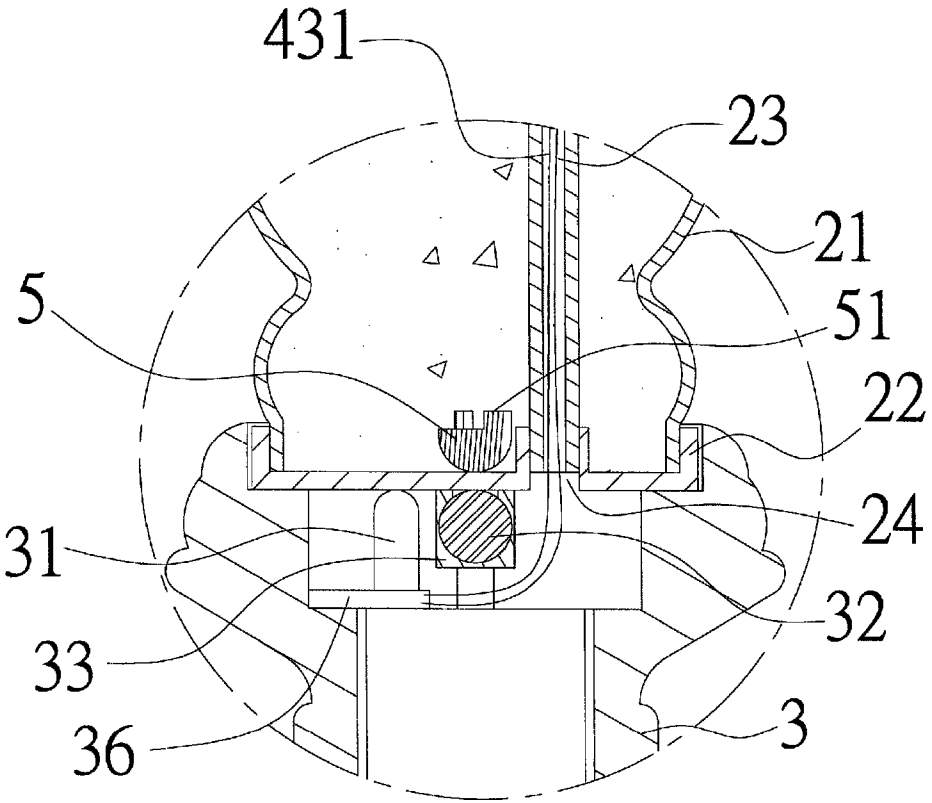
FIG. 9*a* is an enlarged diagram showing the arrangement of wires from a socket to a circuit board of the lampstand of FIG. 8.

As shown in FIGS. 5 and 6, a second embodiment of the present invention is a lampstand for a lamp using a LED light bulb. In the present embodiment, a socket 43 is configured inside the accommodation space 41 of the upper seat 4. The socket 43 receives a light bulb L. Additionally, a lampshade 6 is joined to the upper seat 4. In the present embodiment, the light bulb L is a LED light bulb. The light bulb L has a switch 7 for turning on and off the light bulb L. In the present embodiment, the switch 7 is configured on a body of the light bulb L. Alternatively, the switch 7 can be configured on the socket 43.

As shown in FIGS. 7 to 10, a third embodiment of the present invention is a lampstand for a lamp using an incandescent light bulb L. What is different from the previous embodiment is that the main member 2 has a vertical channel 23 inside the casing 21 extended downward from the top end of the main member 2 to a through hole 24 of the bottom cover 22 so as to allow the socket 43 electrically connected to the circuit board 36 by wires 431 through the channel 23 and the through hole 24. The light bulb L then can be turned on and off by the switch 25. An inner surface of the channel 23 has a layer of coating 25 by applying patterned sticker, painting, sand blasting etc., whose purpose is to hide the wires 431 and to beautify the main member 2 so that the channel 23 and the fluid, spangles, glittering powders inside the main member 2 jointly provide layered visual effect.

Figure 11:
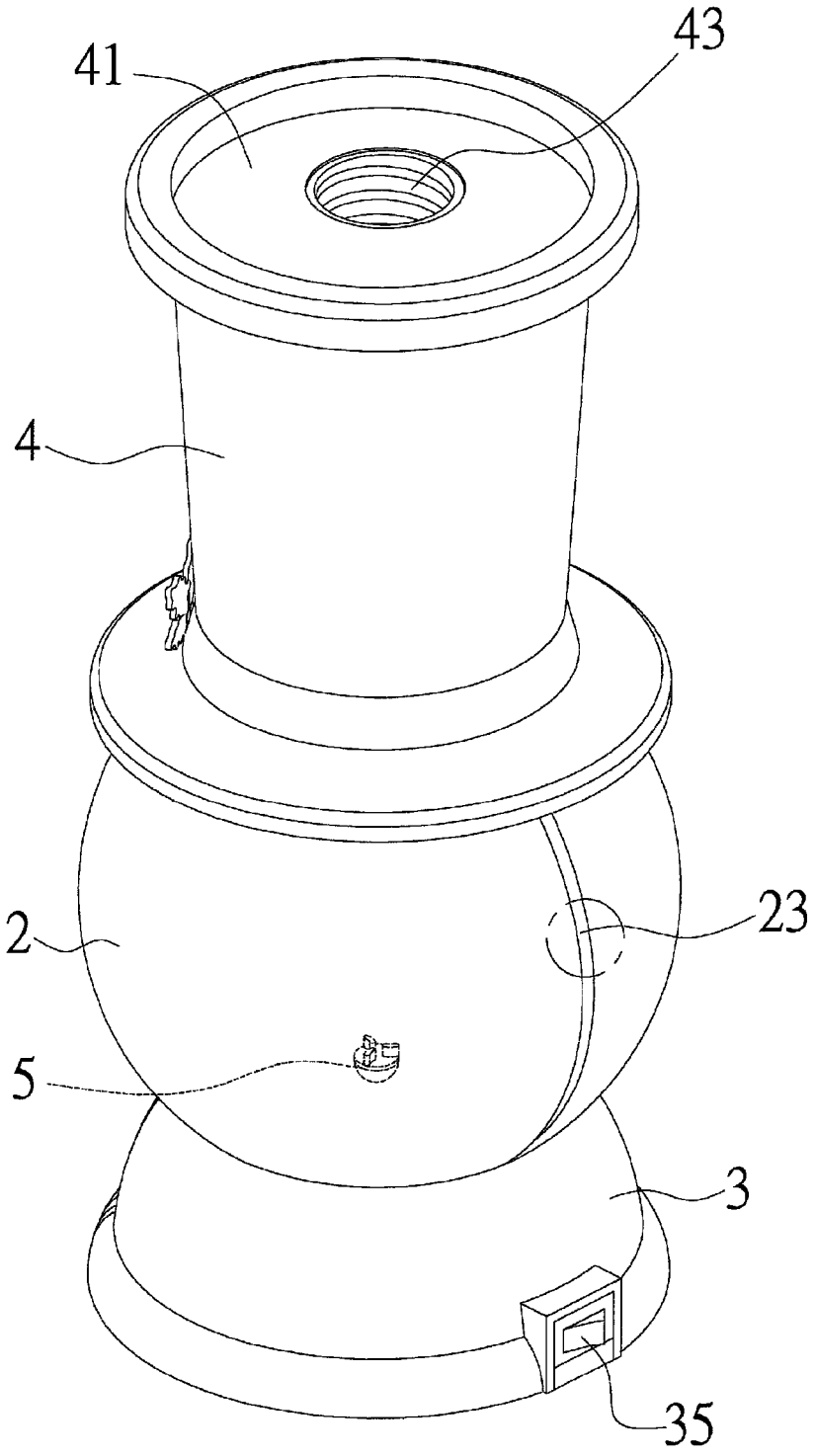
FIG. 11 is a perspective diagram showing a water lamp functioning as a lampstand according to a fourth embodiment of the present invention.
Figure 11A:
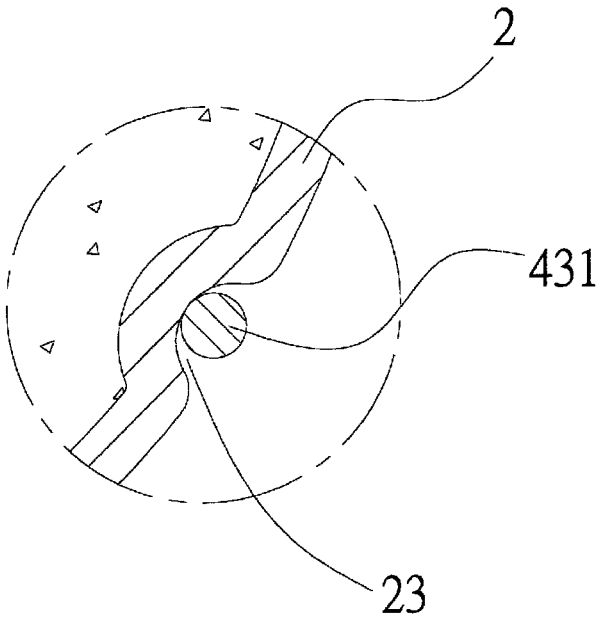
FIG. 11*a* is an enlarged diagram showing the arrangement of wires of the lampstand of FIG. 11.

FIGS. 11 and 11*a* depict a fourth embodiment of the present invention. What is different from the previous embodiment is that the channel 23 is configured vertically on and along a circumference of the main member 2. The wires 431 are embedded inside the channel 23.

The switch 35 can be a manual switch as depicted in FIG. 10. Alternatively, a touch-sensitive switch can be implemented and, in this case, the base 3 is made of a metallic material. The details about the touch-sensitive switch should be familiar to those skilled in the art and therefore are omitted here.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A water lamp, comprising:

a main member comprising a translucent casing, a translucent bottom cover joined to a bottom end of the casing, a fluid housed in a hollow body jointly formed by the casing and the bottom cover, and a channel inside the casing extended downward from a top end of the main member to a through hole of the bottom cover;

a base joined to the bottom end of the main member comprising an illumination element, a magnetic axle, and a circuit board inside the base and beneath the bottom cover;

an upper seat joined to the top end of the main member and having an accommodation space with an open top; and an agitation element housed in the main member self-standing on the bottom cover and having a semi-spherical shape with fins on a planar top side;

wherein the agitation element is attracted magnetically by the axle and spins along with the axle so as to agitate the fluid inside the main member.

2. The water lamp according to claim 1, wherein the upper seat comprises a socket inside the accommodation space for receiving a light bulb.

3. The water lamp according to claim 2, wherein socket is electrically connected to the circuit board by wires through the channel and the through hole.

4. The water lamp according to claim 3, wherein an inner surface of the channel has a layer of coating.

5. The water lamp according to claim 2, further comprising a lampshade joined to the upper seat.

6. The water lamp according to claim 1, further comprising a switch on the base for turning on and off the control circuit.

7. A water lamp according to claim 6, wherein the switch is touch-sensitive switch.

8. A water lamp according to claim 2, wherein the light bulb has a switch for turning on and off the light bulb.

9. The water lamp according to claim 1, wherein the circuit board comprises a power element driving the axle.

* * * * *